United States Patent [19]

Takagi

[11] Patent Number: 4,462,521

[45] Date of Patent: Jul. 31, 1984

[54] TRANSFER MECHANISM

[75] Inventor: Tomio Takagi, Niihama, Japan

[73] Assignee: Sumitomo Heavy Industries, Ltd., Tokyo, Japan

[21] Appl. No.: 335,407

[22] Filed: Dec. 29, 1981

[51] Int. Cl.[3] ..... B65G 25/00

[52] U.S. Cl. ..... 198/621; 198/774

[58] Field of Search ..... 198/621, 740, 855, 858, 198/859, 774; 414/751

[56] References Cited

U.S. PATENT DOCUMENTS

| | | | |
|---|---|---|---|
| 3,655,070 | 4/1972 | Haydu | 198/621 |
| 4,168,611 | 9/1979 | Woyton et al. | 198/855 |
| 4,236,626 | 12/1980 | Noe | 198/744 |

FOREIGN PATENT DOCUMENTS 45-34758 11/1970 Japan .

*Primary Examiner*—Joseph E. Valenza
*Assistant Examiner*—Kyle E. Shane
*Attorney, Agent, or Firm*—Armstrong, Nikaido, Marmelstein & Kubovcik

[57] ABSTRACT

A transfer mechanism for transferring articles one by one from one position to another position, particularly for use with a forging press having a plurality of molds arranged in series to successively transfer blanks from a receiving position to the mold of the first step and then to the mold of the second step and so on. The transfer mechanism comprising a pair of parallel feed bars provided on their opposing surfaces with plural pairs of clamping jaws and three separate sets of hydraulic cylinders for moving the feed bars in three orthogonal directions, respectively, and cam-operated hydraulic pumps operated with cams mounted in different phases on a drive shaft rotated in timed relation with the forging press, each cam-operated hydraulic pump being hydraulically connected to one of working chambers of each hydraulic cylinder and the other chamber of each hydraulic cylinder being connected to an accumulator for accumulating working oil at a predetermined pressure so that the feed bars effect cyclic movement to clamp, lift up, carry ahead, lift down, and unclamp blanks and to return to an original position.

5 Claims, 7 Drawing Figures

TRANSFER MECHANISM

BACKGROUND OF THE INVENTION

The present invention relates to a transfer mechanism for successively transferring articles in one direction and, more particularly, to a transfer mechanism suitable for use in articles in a machine having a plurality of molds arranged in series, the articles or blanks being transferred from a receiving position to a first step and then to a mold of a second step.

A typical known transfer mechanism conventionally used for this purpose includes a pair of substantially parallel feed bars, a plurality of clamping jaws provided on the opposing surfaces of the feed bars, means for supporting the bars for movement in three orthogonal directions, and three independent drives operable in timed relation to effect cyclic movement of the bars in the three directions successively. In operation, two feed bars are moved toward each other to so that each pair of opposing clamping jaws clamps therebetween one blank. The bars are then moved upwardly so that the plurality of blanks clamped between pairs of clampings jaws are lifted simultaneously. Then, the bars are moved ahead by a predetermined distance and, after being lowered to a predetermined level, are moved away from each other to release all the blanks. The bars are finally moved back to resume the initial position.

In this conventional transfer mechanism, each drive comprises a drive shaft device including a shaft driven by the driving power source of the press or by an independent electric motor and a plurality of cams and gears mounted on the shaft, a plurality of levers, links and transmission shafts adapted to operate following up the motion of the drive shaft device, and a plurality of pneumatic cylinders adapted for bringing the levers into engagement with the cams.

In this conventional mechanism, the feed bars are operated at speeds determined by the contours of cams. It is, therefore, possible to obtain a very smooth movement of the feed bars without suffering any substantial impact and vibration. In consequence, various transfer failures such as incorrect clamping of the blank by the jaws, dropping of the same during forward movement and so forth are avoided.

This conventional mechanism, however, has the following drawbacks. Firstly, since the levers, links and other sliding members adapted to be operated by the cams are required to have sufficiently high rigidity, the weight of these parts is increased to impose a practical limit in increasing the speed of operation of the transfer mechanism. Secondly, it is to be pointed out that this conventional mechanism of pure mechanical driving type has an impractically complicated construction, requiring much labor and time in maintenance and resulting in a high cost of production.

In order to obviate the above-explained drawbacks of the mechanical drive, it has been proposed by the inventor herein to actuate the feed bars hydraulically. In such hydraulic drive systems, however, the supply and discharge of the hydraulic oil to and from the hydraulic cylinders for driving the feed bars are controlled by means of a selector valve adapted to switch the direction of flow of the oil coming from a hydraulic pump. Therefore, the movement of the feed bars in each direction is made at a constant speed from the start to the finish of each motion and the motions are performed in a discontinuous manner by the switching of valves in accordance with limit signals. Impacts and vibrations thus, inevitably take place in the operation of the transfer mechanism. To avoid the generation of impacts and vibrations, it is necessary to delicately control the opening of the valves during a very short period of time. Such control, however, is quite difficult to achieve from a technical point of view and requires a highly complicated and expensive control device solely for this purpose.

SUMMARY OF THE INVENTION

Accordingly, an object of the invention is to provide an improved transfer mechanism capable of obviating the above-described problems of the prior art.

To this end, according to the invention, there is provided a transfer mechanism in which the movement of feed bars in each direction is effected by an independent hydraulic cylinder, one of the working chambers of which is adapted to be supplied with the working oil from a cam-operated hydraulic pump. The cams for operating the hydraulic pumps are mounted on a common drive shaft at predetermined phase differences so that the hydraulic cylinders for driving the feed bars are activated successively in a predetermined sequence at speeds varied in accordance with the cam contours, as the drive shaft is rotated by a suitable power source. The other chamber of each hydraulic cylinder is connected to an accumulator for accumulating oil at a predetermined pressure so that in the return stroke of the cam-operated hydraulic pump the working oil is supplied from the accumulator to the hydraulic cylinder to move the feed bars backward.

According to the invention, it is thus possible to effect the desired speed control of the feed bars in each action, thereby to ensure a smooth and safe transfer of the successive pieces of blank. In addition, the mechanism as a whole can have a simplified construction with reduced weight, which in turn affords various advantages such as higher speed of operation, reduced cost of production and easier maintenance.

The invention will be more fully understood from the following description of the preferred embodiments taken in conjunction with the accompanying drawings.

DESCRIPTION OF THE PREFERRED EMBODIMENTS

Figure 1:
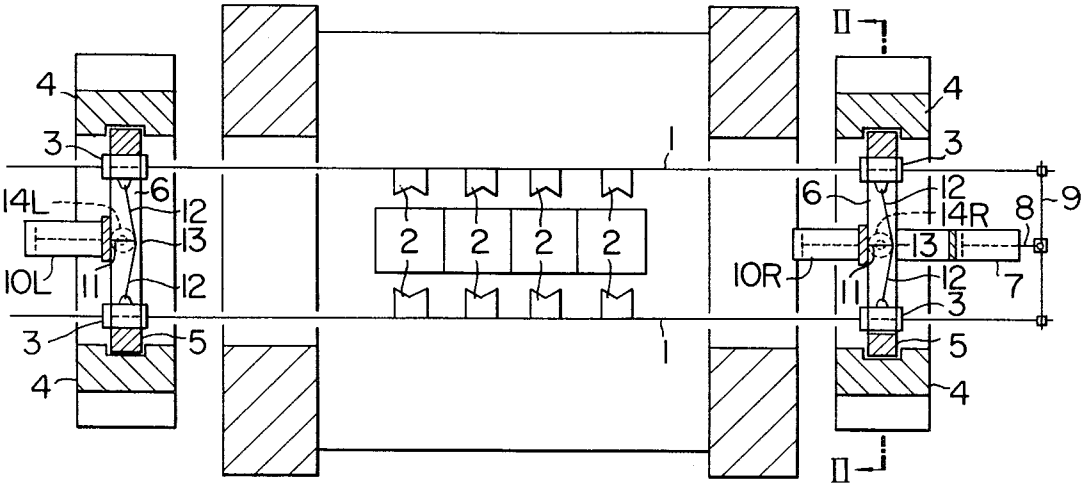
FIG. 1 is a schematic horizontal sectional view of the whole transfer mechanism in accordance with the invention.

Referring to FIGS. 1 thru 4 showing an embodiment of the invention, a pair of feed bars 1 are provided on their opposing surfaces with pairs of opposing clamping jaws 2, 2 and supported at their ends to be slidable within respective supports 3. Lift frames 5 are guided by a frame 4 for vertical movement. Holes 6 formed in the lift frames 5 are adapted to support the feed bar supports 3 for movement in the horizontal direction, i.e. in the direction perpendicular to the feed bars 1. An advance cylinder 7 is fixed to the lift frame 5 and adapted to drive the feed bar 1 forward or backward. The cylinder 7 has a piston rod 8 which is connected to a cross bar 9 engaged with the feed bars 1. Clamp cylinders 10R and 10L are fixed to the lift frame 5 and adapted to drive the feed bars 1 to and from each other thereby making the jaws 2, 2 on the feed bars 1 clamp or release the blanks. Each clamp cylinder has a piston rod 11 which is connected by means of a pin 13 to one end of links 12 of an equal length, the links 12 being pivotally connected at their other ends to the feed bar supports 3. The vertical movement of the lift frames 5 are caused by lift cylinders 14R, 14L.

An explanation will be made hereinunder with reference to FIG. 4 as to the hydraulic circuit for sequentially operating the advance cylinder 7, clamp cylinders 10R and 10L and the lift cylinders 14R and 14L.

Each of these cylinders is a double-acting cylinder having a backward chamber 7', 10R', 10L', 14R', 14L' which is connected through a line 17 to an accumulator 40 provided in an oil pressure generating section A. The forward chambers 7'', 10R'', 10L'', 14R'', 14L'' of respective double-acting hydraulic cylinders are connected through lines 16 to hydraulic cam pumps 26, 27, 28, 29, 30 adapted to be operated by rotary cams 21, 22, 23, 24, 25. The lines 16 are connected to a relief valve 36 through respective non-return valves 15 and also to the accumulator 40, via a line 17' through respective non-return valves 34 and a pressure reduction valve 20.

The oil pressure generating section A includes the accumulator 40, a hydraulic pump 38 adapted to be driven by a motor 37 and connected to the line 17 through a non-return valve 39, a relief valve 35, and a pressure switch 41 adapted to operate when the internal pressure of the line connected to the accumulator 40 has become greater than a predetermined set pressure. When the pressure switch 41 is turned on, the pressurized oil delivered from the hydraulic pump 38 is unloaded through the relief valve 35 or the motor 37 for driving the hydraulic pump 38 is stopped.

Figure 3:
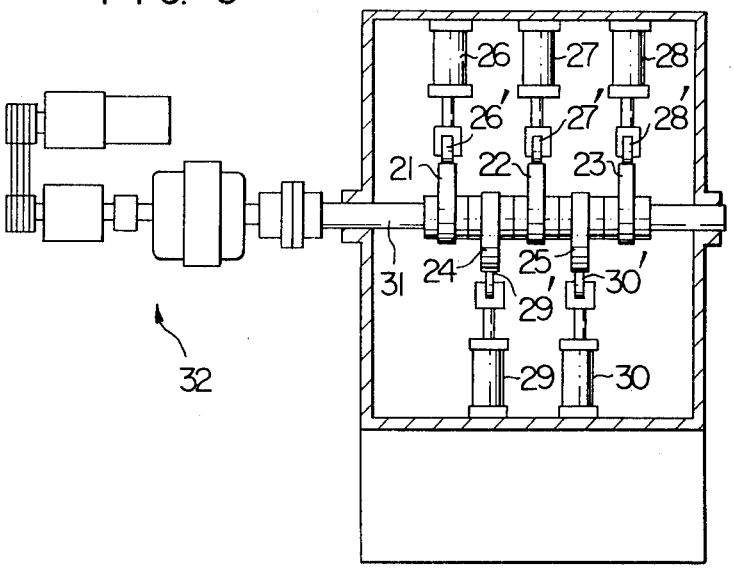
FIG. 3 is a schematic illustration of cam-operated hydraulic pump; and a driving system for driving the pumps.

As will be clearly seen from FIG. 3, the rotary cams 21, 22, 24 are mounted on the cam shaft 31 at predetermined phase differences, while the rotary cams 23 and 25 are attached to the same cam shift 31 at the same phases, i.e. same angular positions, as the rotary cams 22, 24.

In FIG. 3, a reference numeral 32 designates a driving power source for rotatively driving the cam shaft 31. However, the power souce 32 may be dispensed with if the cam shaft 31 is rotatively driven by the driving power source of the press.

In operation, hydraulic pressure is stored in the accumulator 40 by driving the hydraulic pump 38 by the electric motor 37. As the pressure accumulated in the accumulator 40 reaches a predetermined level necessary for the operation of the system, the pressure switch 41 operates to stop the hydraulic pump 38 thereby to maintain a predetermined pressure in the accumulator 40. The pressure in the accumulator 40 is applied to the backward chambers 7', 10R', 10L', 14R', 14L' of the hydraulic cylinders, causing the oil in the forward chambers 7'', 10R'', 10L'', 14R'', 14L'' of the same is to be forced back into the cam-operated hydraulic pumps 26, 27, 28, 29, 30. In consequence, the piston rod ends 26', 27', 28', 29', 30' are pressed onto the peripheral surfaces of the cams 21, 22, 23, 24, 25. The transfer mechanism is now ready to operate. Then, as the cam shaft 31 is rotatively driven in synchronism with the driving source of the press, the cam-operated hydraulic pumps 26, 27, 28 and 29, 30 are driven in accordance with a predetermined sequence, thereby to supply the working oil to the hydraulic cylinders 7; 10R, 10L and 14R, 14L in accordance with a predetermined program.

When the pressure in the forward chamber 7'' of the advance cylinder 7 is increased to overcome the pressure in the backward chamber 7', the advance cylinder 7 operates at a speed varying in accordance with the rotation speed of the cam 21 and the contour of the same, while forcing back the working oil from the backward chamber 7' to the accumulator, thereby to move the feed bars 1 ahead. The accumulator 40 then produces a resistance to the inertia of the movable parts such as feed bars 1, 1 thereby to prevent any overstroking of these parts. Then, as the cam 21 is further rotated to make the ridge of the cam contour move past the position for engagement with the piston rod end 26' of the cam-operated hydraulic pump 26, the pressurized oil accumulated in the accumulator 40 flows back into the backward chamber 7' of the cylinder 7 so that the cylinder starts its returning stroke, thereby to pull the feed bars backward.

Then, the clamp cylinders 10R, 10L and the lift cylinders 14R, 14L are operated sequentially by the rotation of the cams 22, 23 and 24, 25 which are mounted on the cam shaft 31 to operate at predetermined time lags to the operation of the cam 21. Namely, by the operation of these cams, the cam-operated hydraulic pumps 27, 28 and 29, 30 perform their strokes successively so as to drive the clamp cylinders 10R, 10L and the lift cylinders 14R, 14L in the same manner as the operation of the advance cylinder 7, thereby to effect the clamping and unclamping operation and the upward and downward motion of the feed bars 1, respectively.

Figure 5:
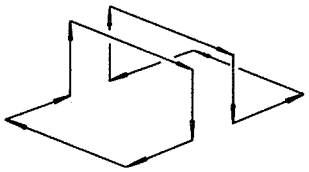
FIG. 5 is an illustration of the loci or paths of movement of feed bars driven by the drive mechanism of the invention.
Figure 2:
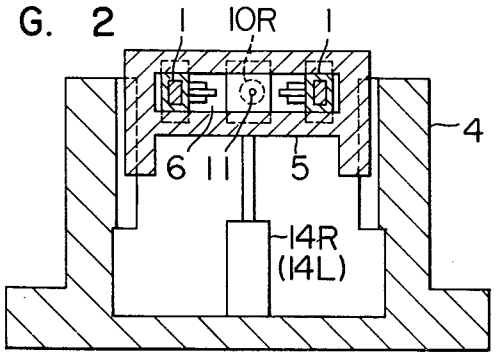
FIG. 2 is a sectional side elevational view of the transfer mechanism taken along the line II—II of FIG. 1.

The feed bars 1 therefore make a three dimensional movement consisting of clamping, lifting, advancing, lowering, unclamping, and returning, so that the clamping jaws of the feed bars are moved along the paths as illustrated in FIG. 5, thereby to successively transfer the pieces of blank.

In the event that the piston of the hydraulic cylinder accidentally fails to perform the designated stroke during forward operation for driving the feed bar, the oil pressure in the line connected to the forward chamber of such cylinder is increased abnormally. Such an abnormal rise of the oil pressure, however, is safely relieved by the relief valve 36 so that the breakage of the line is avoided. Even when there is a shortage of oil in the cam-operated hydraulic pump due to the relief of the oil or leak of the same, the pressurized oil in the accumulator 40 is automatically charged into the cam-operated hydraulic pump after a pressure reduction by the pressure reduction valve 20 forcibly opening the non-return valve 34, thereby to make up for the shortage of the oil, so that the hydraulic cylinder is driven correctly and rapidly, without any change of the stroke.

In the hydraulic circuit described above, the working oil for causing the returning or backward stroke of the hydraulic cylinders is merely displaced in one and the other directions between the accumulator 40 and the backward chambers 7', 10R', 10L', 14R', 14L' of the cylinders, so that there is no substantial consumption of the oil. Therefore, the hydraulic pump 38 is operated only when there is a shortage of the hydraulic oil, so that the consumption of the electric power by the electric motor 37 is reduced to save the running cost.

Figure 4:
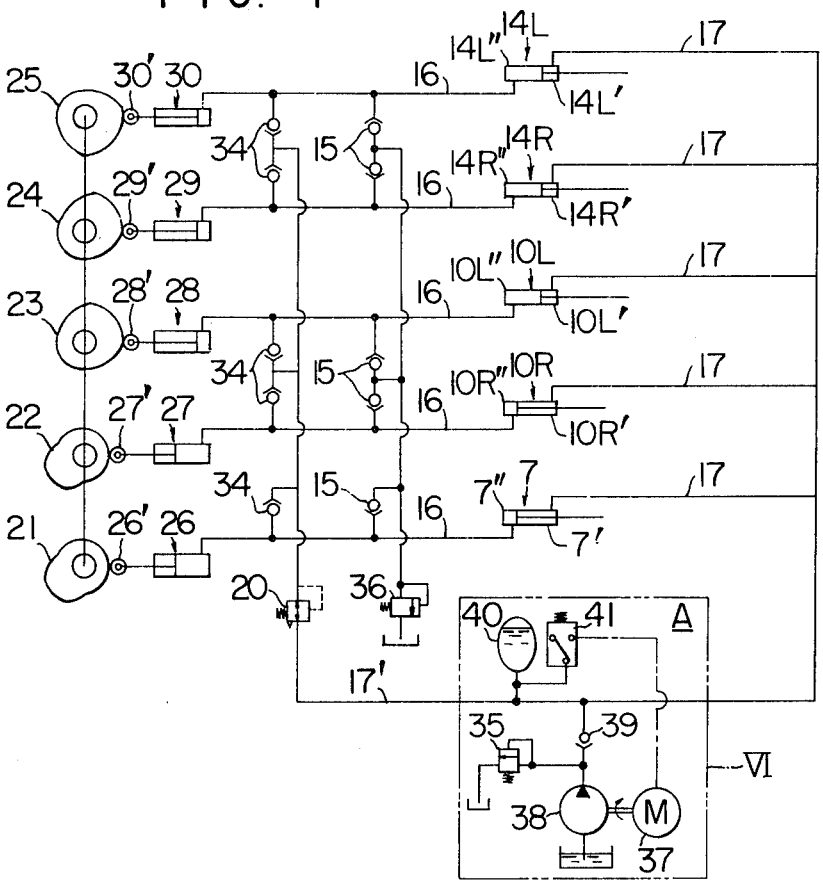
FIG. 4 is a circuit diagram of an example of a hydraulic system incorporated in the transfer mechanism of the invention.
Figure 6:
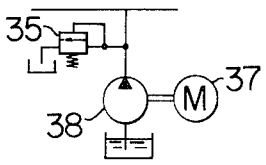
FIG. 6 is a circuit diagram of a modification of a portion of the hydraulic system shown in FIG. 4.

Neglecting the oil consumption, electric power consumption and the shock-absorbing effect for the feed bars, it is possible to omit the accumulator 40 and the non-return valve 39 from the oil pressure generating section A surrounded by a one-dot-and-dash line in FIG. 4 and to modify this section as shown in FIG. 6. In this case, the operating pressure of the relief valve 35 is so set that the hydraulic oil displaced from the backward chambers 7', 10R', 10L', 14R', 14L'in the forward stroking of respective hydraulic cylinders is discharged while forcibly opening the relief valve 35.

As has been described, according to the invention, a plurality of cam-operated hydraulic pumps are operated sequentially by means of a groups of cams mounted on a common cam shaft at predetermined phase differences, and hdyraulic cylinders for driving the feed bars are activated sequentially by the oil delivered from the cam pumps. Therefore, the feed bars are operated quite smoothly at speeds corresponding to the contour of the cams, so that the pieces of the blank are successively transferred without fail by the clamping jaws mounted on the feed bars. In addition the reduced weights of the movable parts permit a higher speed operation of the transfer mechanism and the construction of the transfer mechanism as a whole is remarkably simplified and facilitates maintenance as compared with the conventional mechanism.

Figure 7:
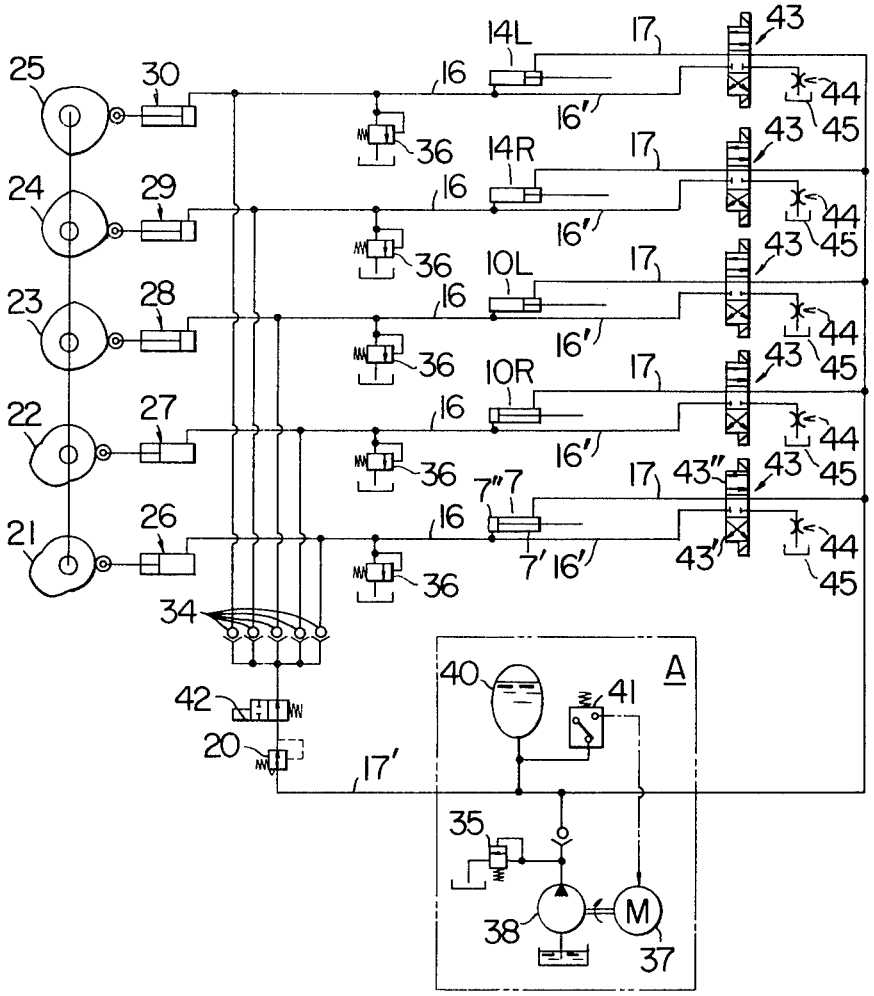
FIG. 7 is a circuit diagram of a second example of the hydraulic system.

Referring to FIG. 7 there is shown another example of the hydraulic circuit which is basically identical to the example as shown in FIG. 4 but further includes additional elements for conducting one-dimensional operation of the feed bars which is desirable for test feed of the feed bars, position adjustment in relation to the molds, re-adjustment after a recovery from a malfunction and so forth. This example is characterized in that a solenoid-operated shut-off valve 42 is disposed in the make-up line 17' leading from the oil pressure generating section A to the cam-operated hydraulic pumps, and that a solenoid-operated three-position valve 43 is provided in each of the lines 17 between the backward chambers of the hydraulic cylinders for driving the feed bars and the oil pressure generating section A, so that it is possible to operate the feed bars 1, 1 only in one direction independently of each other as required. The three-position valve 43 has a first port communicating with the accumulator 40, a second port communicating with the backward chamber of the associated hydraulic cylinder, a third port communicating with the line 16 through a line 16' and a fourth part communicating with a drain. The three-position valve 43 takes a neutral position, a position 43' and a position 43''. In the neutral position, the first and second ports are connected to each other to establish a communication between the backward chamber of the associated hydraulic cylinder and the accumulator 40. In the position 43', the first port is connected to the third port while the second port is connected to the fourth port, thereby to establish a communication between the line 16 and the accumulator 40, as well as a communication between the backward chamber of the associated hydraulic cylinder and the drain. In the position 43'', the first port is connected to the second port while the third port is connected to the fourth port, to establish a communication between the backward chamber and the accumulator 40 and a communication between the line 16 and the drain 45. A restrictor valve 44 is disposed in the line between the fourth port and the drain 45. In this example, it is not necessary to provide the non-return valve 15, because each line 16 has its own relief valve 36.

In this example, the ordinary operation of the circuit for achieving the successive transfer of pieces of blank by the feed bars is made in the same manner as the first example. The one-dimensional operation, i.e. the unidirectional operation, of the feed bars is made in the following manner.

For driving the feed bars 1, 1 in the longitudinal directions forwardly and backwardly, the shut-off valve 42 is activated in accordance with an instruction given through a control panel (not shown) to shut-off the make-up line 17', while stopping the rotation of the cam shaft 31 with the accumulator 40 fully storing the pressure. Then, the three-position valve 43 associated with the hydraulic cylinder 7 is actuated to the position 43' so that the pressurized oil in the accumulator 40 is allowed to come into the forward chamber 7'' of the advance cylinder 7. In consequence, the piston rod of the advance cylinder 7 is extended to drive the feed bars 1, 1 forwardly. Meanwhile, the working oil in the backward chamber 7' of the advance cylinder is discharged to the drain 45 through the restrictor valve 44. The speed of the forward movement of the feed bars 1, 1 is adjustable by means of the restrictor valve 44. Then, the three-position valve 43 is actuated in the reverse direction to the position 43'', so that the pressurized oil in the accumulator 40 is introduced into the backward chamber 7' of the advance cylinder 7 so that the latter makes a backward stroke to retract the feed bars 1, 1. On the other hand, the working oil in the forward chamber 7'' is discharged to the drain 45 through the restrictor valve 44. The speed of the backward movement of the feed bars 1, 1, therefore, is adjustable by means of the restrictor valve 44. In this operation, the make-up line 17' is shut-off by the shut-off valve 42, so that the undesirable discharge of the pressurized oil from the accumulator through the line 16' via the cam-operated hydraulic pump 26 is perfectly avoided. In consequence, the consumption of the pressurized oil in the accumulator 40 is largely decreased. The one-dimensional operation for causing the up and downward movement of the feed bars 1, 1 and the one-dimensional operation for causing the clamping and unclamping motion of the feed bars 1, 1 are achieved by controlling the three-position valves 43 associated with the lift cylinders 10R, 10L and the three-position valves 43 associated with the clamp cylinders 14R, 14L in the same manner as the three-dimensional valve 43 associated with the advance cylinder 7.

The shut-off valve 43 and the three-position valve 43 are reset as the instruction from the control panel is dismissed, so that the transfer mechanism as a whole becomes ready for ordinary sequential operation. The oil pressure generating section A may be substituted by the circuitry shown in FIG. 6, also in this example.

It is to be noted here that the described examples are not exclusive and various changes and modifications may be imparted thereto.

In the described examples, the make-up oil is derived through a pressure reduction valve from a hydraulic pressure generating section which is provided for generating hydraulic pressure for effecting the backward stroking of the hydraulic pressure for effecting the backward stroking of the hydraulic cylinders, but an independent make-up circuit may be used for making up for the shortage of oil. Also, it is a matter of design choice that an independent relief valve 36 is provided in each of the lines 16 instead of a common relief valve 36 used for all of the lines 16.

What is claimed is:

1. A transfer mechanism comprising a pair of substantially parallel feed bars, at least one pair of opposed jaws each jaw being mounted on a corresponding one of said bars, means for supporting said bars for movement in three directions, each direction of movement being substantially perpendicular to the other two directions of movement, an accumulator for accumulating hydraulic fluid at a predetermined pressure and three separate drive means operable to effect cyclic movement of said bars in said three directions, wherein each said drive means comprises at least one double-acting hydraulic cylinder, one of the working chambers of said double-acting hydraulic cylinder communicating with said accumulator, at least one cam-operated hydraulic pump having a working chamber which directly communicates with the other working chamber of said double-acting hydraulic cylinder, and means for driving the cams of said pumps in timed relation to operate said pumps in a predetermined sequence.

2. A transfer mechanism as set forth in claim 1, further comprising a relief valve connected between the other working chamber of said double-acting hydraulic cylinder and the working chamber of said hydraulic pump.

3. A transfer mechanism as set forth in claim 2, wherein said accumulator communicates with the working chamber of said hydraulic pump through a pressure reduction valve and a non-return valve.

4. A transfer mechanism as set forth in claim 3, further comprising a shut off valve connected between said accumulator and the working chamber of said hydraulic pump and a three-position valve having first, second, third and fourth ports communicating with said accumulator, said one chamber of said double-acting hydraulic cylinder, said other working chamber of said double-acting hydraulic cylinder and a drain, respectively, and taking a first position in which communication is established between said first and second ports while no communication is established between said third and fourth ports, a second position in which communication is established between said first and third ports and between said second and fourth ports and a third position in which communication is established between said first and second ports and between said third and fourth ports.

5. A transfer mechanism as set forth in claim 4, further comprising a restrictor connected between said fourth port of said three position valve and said drain.

* * * * *